US010144568B2

(12) United States Patent
Simonetti et al.

(10) Patent No.: US 10,144,568 B2
(45) Date of Patent: Dec. 4, 2018

(54) DISPOSABLE CONTAINER FOR PRECIOUS GOODS

(71) Applicants: Massimiliano Gentili, Piane di Falerone FM (IT); Ginaluca Simonetti, Loreto AN (IT); Leonardo Sciava, Loreto AN (IT)

(72) Inventors: Gianluca Simonetti, Loreto AN (IT); Leonardo Sciava, Loreto AN (IT)

(73) Assignees: Gianluca Simonetti, Loreto An (IT); Leonardo Sciava, Loreto An (IT); Massimiliano Gentili, Plane di Falerone Fm (IT)

( * ) Notice: Subject to any disclaimer, the term of this patent is extended or adjusted under 35 U.S.C. 154(b) by 0 days.

(21) Appl. No.: 15/521,508

(22) PCT Filed: Oct. 20, 2015

(86) PCT No.: PCT/IB2015/058083
§ 371 (c)(1),
(2) Date: Apr. 24, 2017

(87) PCT Pub. No.: WO2016/067157
PCT Pub. Date: May 6, 2016

(65) Prior Publication Data

US 2017/0297798 A1 Oct. 19, 2017

(30) Foreign Application Priority Data

Oct. 28, 2014 (IT) ..... AN2014A0162
Oct. 1, 2015 (IT) ..... 102015057231

(51) Int. Cl.
*G08B 23/00* (2006.01)
*B65D 75/36* (2006.01)

(52) U.S. Cl.
CPC ..... *B65D 75/366* (2013.01); *B65D 75/36* (2013.01); *B65D 2203/10* (2013.01)

(58) Field of Classification Search
None
See application file for complete search history.

(56) References Cited

U.S. PATENT DOCUMENTS 9,542,823 B1 * 1/2017 Russell ..... G08B 13/2402
2006/0255953 A1 * 11/2006 Lyon ..... B65D 55/02 340/572.8

(Continued)

FOREIGN PATENT DOCUMENTS

| | | | |
|---|---|---|---|
| EP | 1964030 | A1 | 9/2008 |
| WO | 2007070902 | A1 | 6/2007 |
| WO | 2010/044041 | A1 | 4/2010 |

OTHER PUBLICATIONS

International Search Report for PCT/IB2015/058083 dated Jan. 1, 2016.

*Primary Examiner* — Julie Lieu
(74) *Attorney, Agent, or Firm* — Pearne & Gordon LLP

(57) ABSTRACT

A disposable container for precious goods is manufactured by mutually joining a base with a preformed recess containing goods to be protected and a closing body. In the joint between the base and the body a transponder device is arranged. A process for checking the integrity and authenticity of a container includes steps of investing the container with a signal coming from an RF-ID reader; verifying the existence of a reply to said signal; transmitting said reply to an information system; comparing, within the information system, the reply with possible acceptable answers; issuing an acceptance or rejection signal, based on the result of the verifying and/or of the comparing, wherein the container consists of a disposable container for precious goods. The RFID reader verifies the integrity and authenticity of dis- (Continued)

posable containers containing jewels, processed or raw precious stones, coins, stamps, small bullions of precious metals, watches.

12 Claims, 9 Drawing Sheets

(56) References Cited

U.S. PATENT DOCUMENTS

| | | | | |
|---|---|---|---|---|
| 2006/0283748 | A1* | 12/2006 | Daio | B65D 75/366 206/460 |
| 2007/0222232 | A1* | 9/2007 | Held | G06K 19/073 292/307 R |
| 2011/0177739 | A1* | 7/2011 | Kiljunen | B32B 7/12 442/290 |
| 2011/0313894 | A1* | 12/2011 | Dye | G06K 19/0776 705/28 |
| 2014/0077509 | A1* | 3/2014 | Vafadari | G09F 3/0323 292/307 R |
| 2016/0148543 | A1* | 5/2016 | Spreck | B05D 3/12 206/459.5 |
| 2017/0004741 | A1* | 1/2017 | Maltas | G09F 3/0295 |
| 2017/0032710 | A1* | 2/2017 | Debrody | G09F 3/0317 |
| 2017/0323588 | A1* | 11/2017 | Marchesano | G09F 3/03 |

* cited by examiner

Fig. 6A
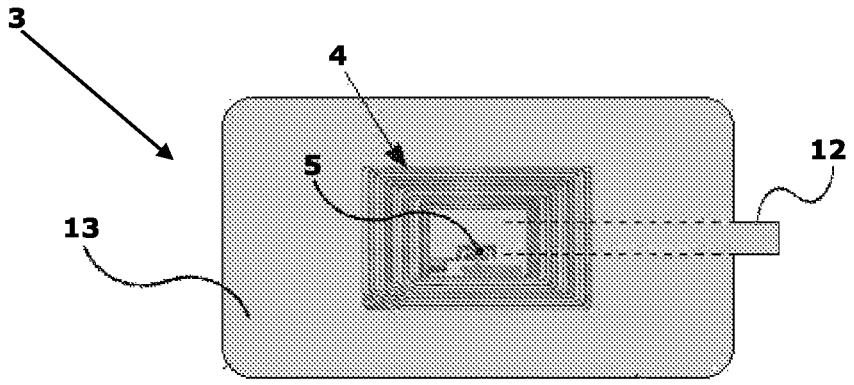
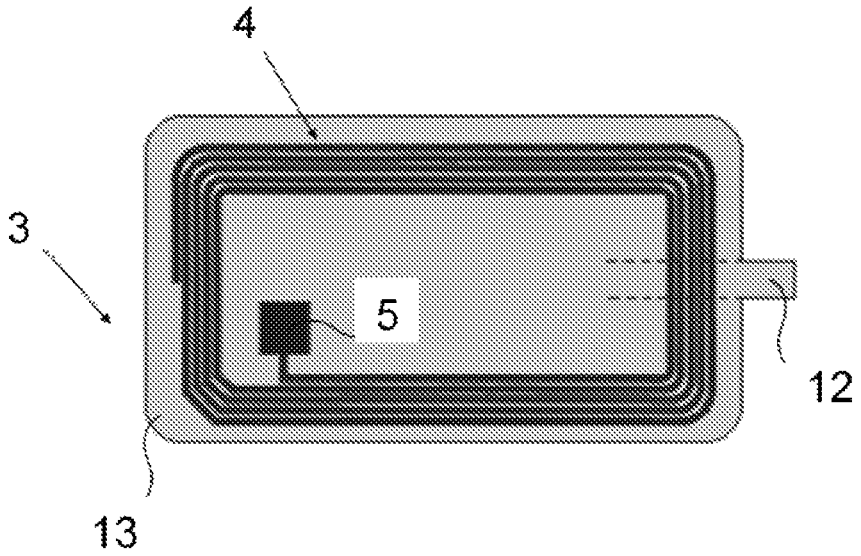
Fig. 6B

DISPOSABLE CONTAINER FOR PRECIOUS GOODS

This is a National Stage application of PCT international application PCT/IN2015/058083 filed on Oct. 20, 2015 which claims the priority of Italian application no. AN2014A000162 filed Oct. 28, 2014 and Italian application no. 10201500005723 filed Oct. 1, 2015, entitled "DISPOSABLE CONTAINER FOR PRECIOUS GOODS", each of which are incorporated herein by reference in their entirety.

The present invention refers to a disposable container for precious good, with electronic signalling of the integrity and authenticity thereof, useful wherever it is necessary to understand in real time if it has been opened and/or tampered somehow.

One of the most pressing problems in the sector of jewelry trading is that of the counterfeiting of the same. Precious stones are normally marketed in suitable sealed and at least partly transparent containers, in order to allow the viewing thereof from the outside. Given the high value of the stones, both raw and processed ones, they have always been among the preferred objects for thefts and scams. Therefore, next to ordinary thefts—which normally imply high risks for those who commit them—, there are counterfeiting forms which often prove highly rewarding for those who commits them and much harder to uncover by victims than thefts, hence less risky to perform. For example, among the many people who handle, even for a short period of time, a precious stone in the path from the mine to the final purchaser, there could be some inclined to replace the precious stone with a non-precious one or with an imitation or at least with a stone of a lesser value (for example replacing a diamond with a zircon). Thereby, the theft could remain long unnoticed, since, in any case, a precious stone travels the various usual stations for the marketing thereof in a relatively long period of time, considerably reducing the risk of being discovered.

In order to limit this problem, security systems have been devised, aimed at showing the occurred tampering of the stone container. The most common method is that of used the so-called "security packing system" known under the system name VOID (cancelling seal validity). The stone is arranged in a small sealed container. A VOID system is illustrated in FIGS. 1 to 4. A container of this type consists of a bottom tile 1, flat as any tile, and of a preformed base 2 having a thermoformed cavity, normally of a highly transparent plastic material. The preformed base 2 comprises a deep-drawing which allows to contain the stone, offering a first glance thereof from the outside. The two parts are mutually sealed in a known manner, for example with a hot process employing adhesives. Following sealing, it is no longer possible to analyse the stone to verify the features and/or the authenticity thereof, but breaking the seal, so that any guarantee thereof of correlation between the stone and the certification thereof is lost. Said system is hence the only tool to refer to as guarantee of the fact that the stone comes directly from the certifying body. Normally, these containers are made of polycarbonate or of polyester and preformed base 2 is obtained by thermoforming a plate. The inner part of bottom tile 1 (in contact with preformed base 2) is pad printed or silk-screen printed with inks, so that the opening of the container, due to the glues, tears bottom tile 1 and transfers part of the ink, in the form of a message of occurred effraction, from said tile to preformed base 2. The same sentence remains written in negative (missing the ink, which has been transferred to preformed base 2) on the part of bottom tile 1 in contact with preformed base 2, or vice versa.

Thereby, upon opening of the container, a sentence can be seen which attests the occurred opening. An uncontrolled scattering of ink may also be simply provided. On bottom tile 1 and/or on preformed base 2 a code of any type is reported which allows, connecting for example to the website of whoever certifies the stone, to obtain and print the certificate of gem (electronic copy) or an equivalent document.

This system is certainly valid, but may be got round relatively easily. It is sufficient for the counterfeiter to use another container of equal features which reports the same data and which is sealed following the replacement of the original stone, to cause the fake stone or the lesser-value stone to be considered perfectly valid and certified by the purchaser.

For the counterfeiter it is even sufficient to create a series of copies of bottom tile 1 and to reuse the original, violated preformed base 2—with which to repeat the scam—where the identification code to recall on the site of the certifying body is the same, always relating to a stone considered authentic, to leave in the subsequent purchaser the impression that the stone is the one actually looked for, without that being actually true, but in actual fact being in the presence of a fake stone or in any case of a lesser-value stone.

Such counterfeiting system is thriving; as a matter of fact, it is devised with the opportunity to find information from the web. The reference characters of the commercial chain, for example those who normally sell diamonds on-line or on tv, the trusted jeweler, or even the very certifying bodies, always put at the final user's disposal the gemmological certificate of the stones. It will suffice to read the certificate information to create a blister clone which reports the correct reference codes and features. In the light of this fact, it is clearly understood that whoever has started a fraudulent business based on counterfeiting enjoys a huge potential.

The state of the art in the field of the fight against counterfeiting therefore today imparts only a passive protection, not allowing, in substance, to understand if the container which is being examined (without messages of occurred effraction) is the original one or not. Moreover, it must also be taken into account that, given how they are manufactured and handled, these containers often have areas where the glue, due for example to heat or the forming of air bubbles, can no longer adhere. Hence, even small ungluings and imperfections of the sealing are seen as a normal and inevitable thing, even by the expert purchaser.

The above applies to precious stones, such as diamonds, rubies, sapphires, aquamarine, small bullions of precious metals, coins, stamps and the like. Sometimes, moreover, especially when the stone is given as a present, it remains in the container for years, without it being opened, so that the security system remains a post-sale control system and gives no guarantee to the purchaser.

Another complementary system used is that of including on the surface of preformed base 2 (or on bottom tile 1) holograms or prints with ink visible only under ultraviolet light (UV) and not under normal light. However, by copying the holograms and by using suitable UV-sensitive inks (easily found), even such method is easily reproducible.

In all the cases just illustrated, it would be suitable to have a container which proves the authenticity thereof in real time, before the opening thereof and which, if opened, accidentally or with malice, allows to detect the effraction with utter certainty, removing any chance of using counterfeited containers or violated parts of original containers. Up until today that has not been possible.

The problem at the bottom of the invention is to propose a container which overcomes the mentioned drawbacks and which allows to verify at any time the integrity and authenticity thereof. This object is reached through a disposable container for precious goods, manufactured for a single and univocal object, produced by mutually joining a base with a preformed cavity containing the good to be protected and a closing body, characterised in that a transponder device is arranged in the joining between said base and said body.

The present invention, according to a second aspect, refers to a process for verifying the integrity and authenticity of a container, comprising the steps of:

a) investing the container with a signal coming from an RF-ID reader;
b) verifying the existence of an answer to said signal;
c) transmitting said answer to an informative system;
d) comparing, within the informative system, the answer with possible acceptable answers;
e) issuing an acceptance or rejection signal, based on the result of step b) and/or of the comparison occurred in step d), characterised in that said container consists of a disposable container for precious goods as mentioned above.

Finally, according to a third aspect, the present invention refers to the use of an RFID reader device, for verifying, the integrity and authenticity of disposable containers according to the first aspect, containing jewels, processed or raw precious stones, coins, stamps, small bullions of precious metals, watches. The dependent claims disclose preferential features of the invention.

Further features and advantages of the invention are in any case more evident from the following detailed description of a preferred embodiment, given purely as a non-limiting example and illustrated in the attached drawings, wherein:

FIG. 6 shows the transponder in two different embodiments according to the present invention, in particular:

FIG. 6A shows the antenna which covers the object-carrying recess; and

FIG. 6B shows the antenna which surrounds said recess;

Figure 11:
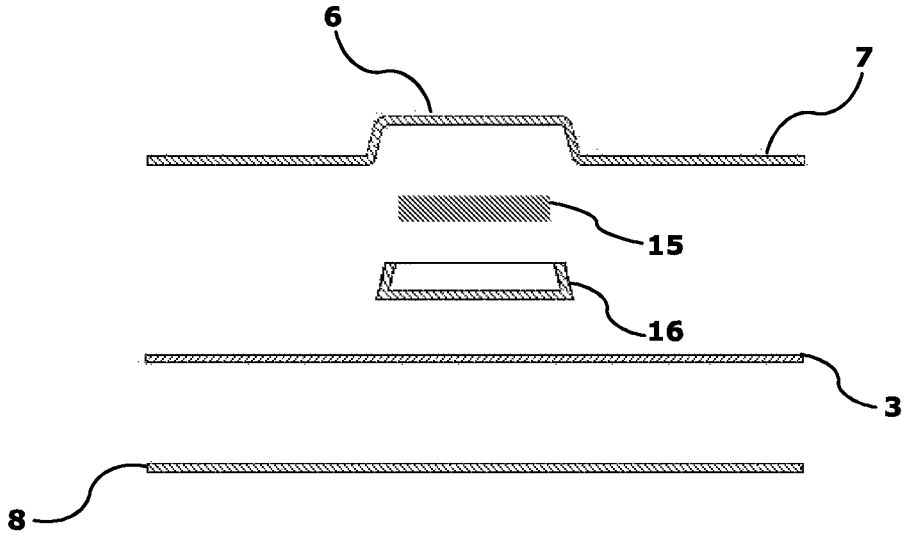

As stated, the present invention provides to arrange in the container a transponder; and FIG. 11 shows, with parts removed, a further embodiment of the present invention.

Figure 1:
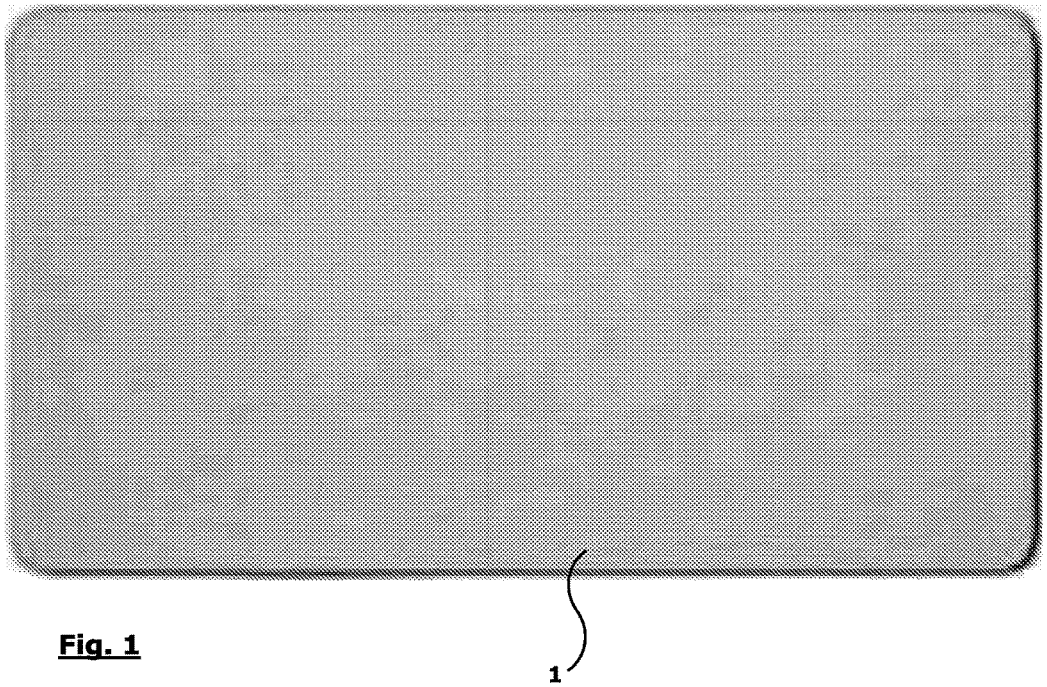
FIG. 1 is a top plan view of a bottom tile for a container according to the prior art.
Figure 2:
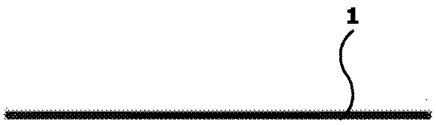
FIG. 2 is a lateral view of the same tile.
Figure 3:
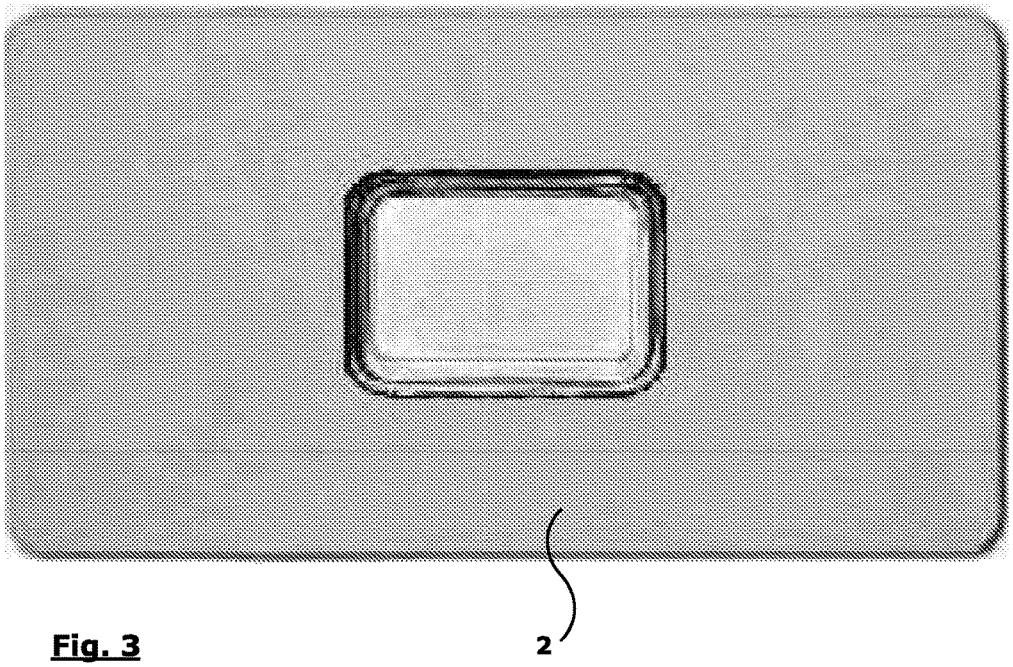
FIG. 3 is the top plan view of a base with a preformed cavity for the same container of FIGS. 1 and 2.
Figure 4:
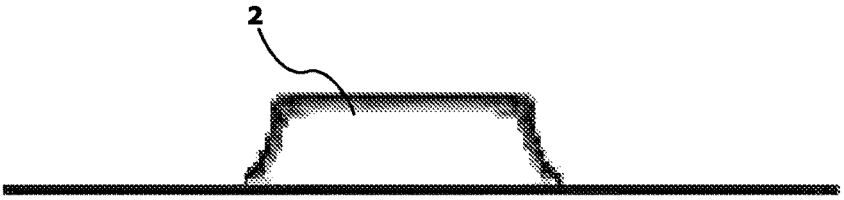
FIG. 4 is a lateral view of the preformed base of FIG. 3.
Figure 5:
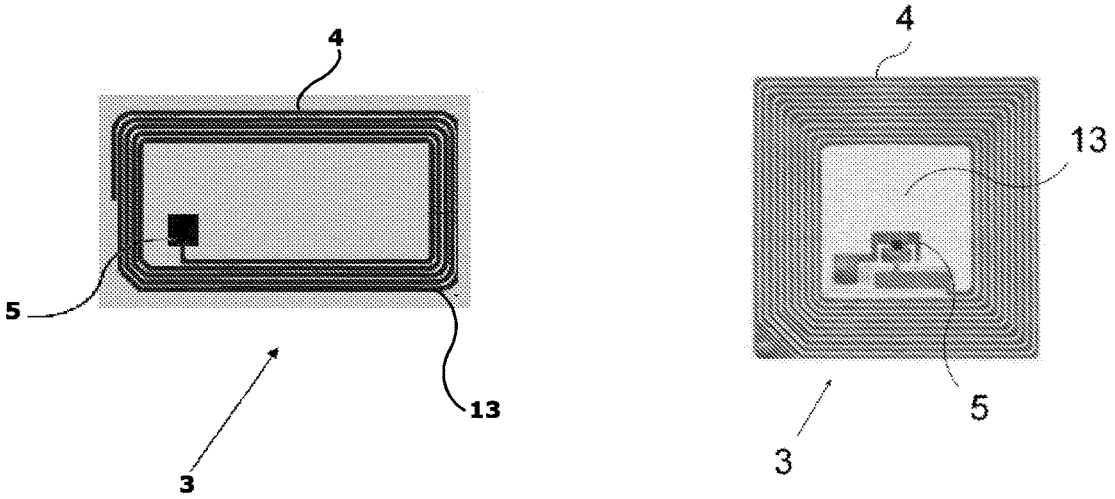
FIG. 5 are two general transponder schemes of different shapes, where the microchip, the antenna and the substrate acting as physical support for said microchip and said antenna can be noticed.
Figure 7:
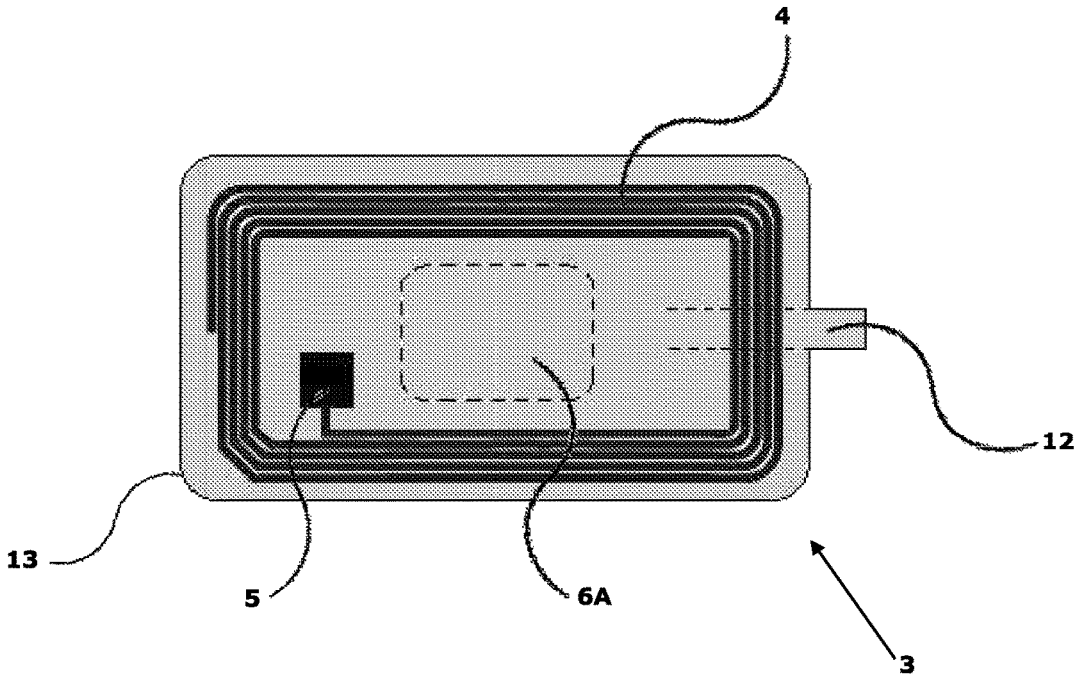
FIG. 7 shows the bottom tile of FIG. 6B which surrounds the deep-drawn area of the preformed base (critical area)

FIG. 5 shows a generic transponder 3. It comprises, in a known manner, an antenna 4 connected to a microchip 5. Said components, antenna 4 and microchip 5, rest on a support called substrate 13 which can be of a different nature, generally it is plastic or paper.

Microchip 5 contains, in addition to the management components, a non-volatile memory, with univocal and non-modifiable code; said code is assigned to microchip 5 in the factory, upon the manufacturing and programming thereof.

In general, transponder 3 is employed in a so-called RFID system (radio-frequency identification system), answering queries of a receiving-transmitting apparatus, which in the present application is called, for simplicity's sake, reader. The reader normally sends the data, received in reply to an own query, to an informative system which processes the data and triggers appropriate actions based on such data. A typical RFID system (of an active type, since it comprises the supply, normally batteries) is the one known in Italy under the name TELEPASS®, that is, the system which allows to pay the toll of a motorway without the need to stop at the gate. Other examples of use of the transponder, but of a passive type (lacking supply), among many, are the control and management of company presences and accesses, and last-generation credit cards (contactless).

In general, in an RFID system of this (passive) type, a cheap microchip is used and the cost of the same must be as low as possible. The univocal code of the microchip (assigned in the factory upon chip creation) and the information contained therein, recognised by the check database, are readable by any RFID detection tool (reader). Said information, in the specific case of the present invention, is encrypted by a high-value algorithm, to be able to prevent the cloning of microchip 5 itself. Extremely advanced IT knowledge is necessary to be able to try to read said information. The used microchip 5 belongs to the same family as those which are found in credit cards (used for payments) and in governments' documents, hence it has advanced encrypting algorithms.

The present invention provides the use of an RFID transponder of a passive type (that is, without supply batteries), since this type of transponder will allow the detection and identification of the container, through an RFID reader, only at a very short distance (for a maximum of 2-5 meters). That causes it to become unlikely that any ill-intentioned people may, using an RFID reader, detect whoever carries a precious good with themselves and possibly also detect the certificate of the precious good and, in case of interest, assault the carrier to steal the precious good from him. The use of a passive-type transponder is hence an effective system apt to prevent the localisation of a person who carries a precious good. Whoever should carry with themselves the RFID container for precious goods would be traced with relative difficulty in a closed space and with even more difficulty in an open space.

Within the scope of the same passive RFID technology, a standard called NFC (Near Field Communication) exists which even reduces such reading by an RFID scanner/reader to only 5-10 centimeters; preferably, such RFID according to standard NFC operates in the high-frequency field, in a maximally preferred manner, in the frequency bandwidth of 13.56 MHz. Here it is that such technique effectively meets the requirements of a container for precious goods which must not be traced, or in any case detected, since the detection of said container can occur almost virtually in contact of the RFID reader, so that an even higher security degree is reached.

FIGS. 6A and 6B show two alternative transponders. It must be noticed the detail of the tear tab 12 (preferably, but not necessarily, with substrate perforations until reaching the antenna), which allows to easily open the container and to break the antenna and/or the connections thereof, in order to invalidate transponder 3.

The microchip 5 contained in the transponder can be replaced by other types of chip, increasingly modern and sophisticated, in order to be able to guarantee a suitable protection with respect to technology evolution. The system hence becomes flexible and always up to date. In any case, the particular type of chip used is not part of the present invention.

In the case of the present invention, transponder 3 is inserted into a disposable container for precious goods to be sealed and of which one wants to verify any occurred opening. Advantageously, the antenna 4 of transponder 3 may be arranged so that it surrounds or covers the area 6A occupied by a deep-drawing 6 of a preformed base 7. In both cases, it is necessary that a part of antenna 4 and/or the connections thereof are integral with a rigid part of tile 8 or of preformed base 7.

Figure 8:
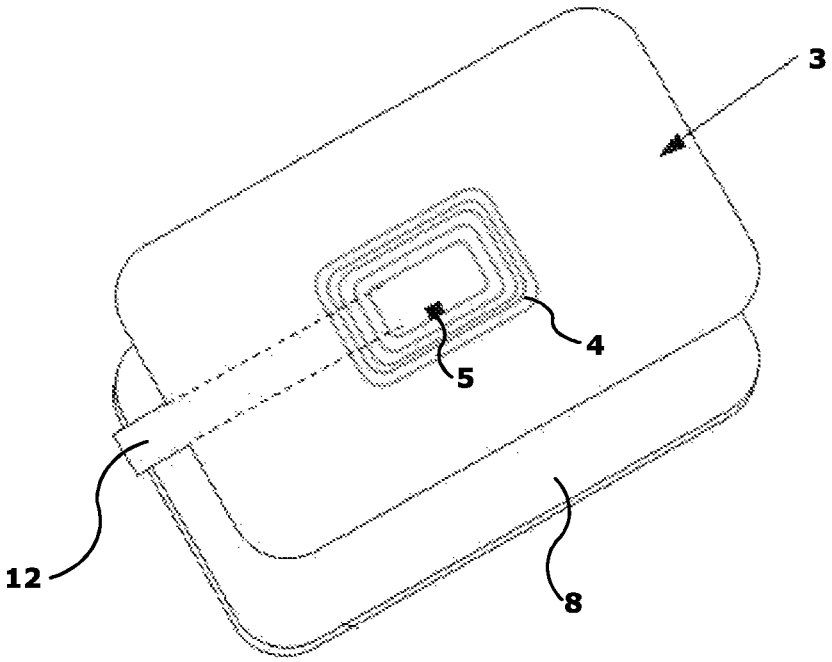
FIG. 8 shows an embodiment of the disposable container according to the present invention with the transponder inserted on the bottom tile.

A first embodiment is shown in FIG. 8.

Figure 10A:
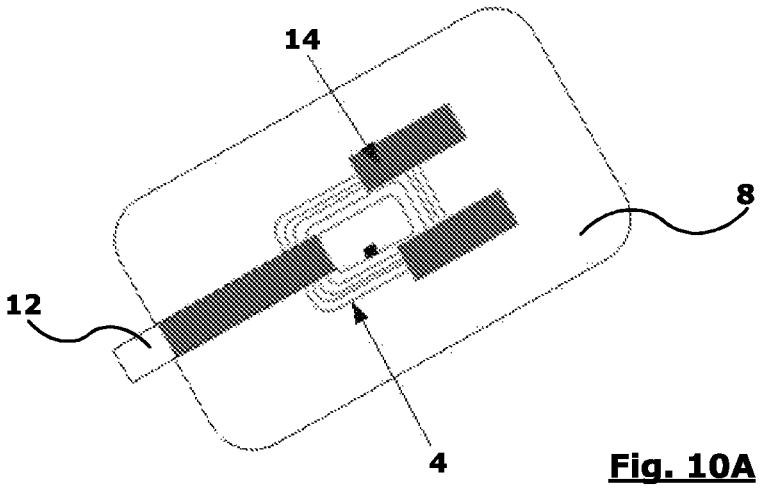
FIG. 10 shows the arrangement of the gluing on the side of the bottom tile (10A) and on the side of the preformed base (10B), based on a preferred embodiment.
Figure 10B:
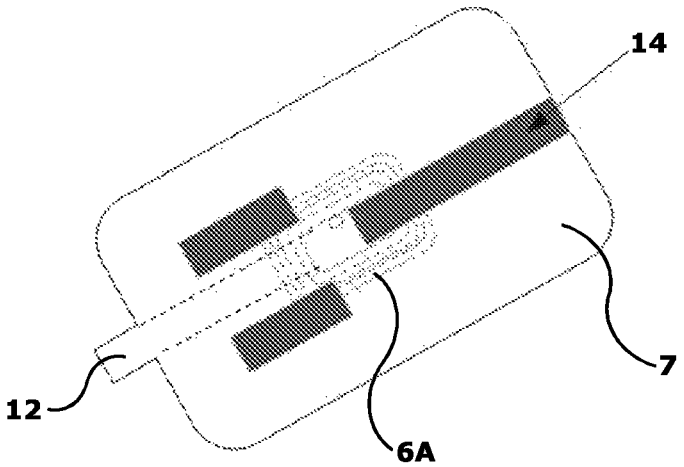

According to this embodiment, transponder 3 is applied, before sealing, onto the bottom tile 8 of the container according to the present invention. That occurs by (hot or cold) gluing, employing a glue or resin which withstands high temperatures so that, heating the parts, the glue does not leave the grip and allows to remove, with extreme ease and integrally, transponder 3 from bottom tile 8 without causing the breaking of antenna 4 and/or of the connections thereof. Once applied transponder 3, preformed base 7 is welded to bottom tile 8 itself with the same glue used for coupling said transponder 3 with said bottom tile 8. A particularly preferred embodiment for the accomplishment of such couplings provides that glue 14 be applied as shown in FIG. 10. Thereby, each face of transponder 3 is glued to a component (preformed base 7 and bottom tile 8) of the disposable container for precious goods according to the present invention and the opening of the container without damaging antenna 4 becomes much more complicated, if not impossible. In order to further increase the security of the container according to the present invention, glue 14 is preferably applied onto microchip 5 and/or onto antenna 4, or onto parts thereof, and/or onto the connections relating to antenna 4. Thereby, a further opportunity to get round the system is prevented. As a matter of fact, it could be assumed to use hydrochloric acid to dissolve glue 14; however, in the presence of oxygen, hydrochloric acid attacks copper, corroding it and brining it too in solution, so that transponder 3 would be disconnected in any case.

Even though such gluing layout is only one of the many representations of how the system must be glued [since it varies also based on the type of transponder (see FIG. 6)], in a nutshell, it must be taken into account that the area where the glue is inserted on the side "bottom tile-transponder" are not the same, taken as reference for the gluing onto the side "preformed base-transponder". The area of glue 14 can be more or less wide or it could consist of many small gluing areas. The tear of the antenna and/or of the connections thereof occurs because one part of the transponder remains glued onto bottom tile 8 and the other remains glued to preformed base 7.

Other welding systems could also be used, such as for example, but not limited to, ultrasound welding, or even mixed ones (for example ultrasound plus glue etc. . . . ). Even in this case, as in the previous one, it is important to ensure that the transponder parts attached to the bottom tile side 8 are not on the preformed base side 7 and vice versa.

Thereby, by opening the container using the tear tab, a simple opening and the tearing, hence the invalidation, of the transponder is ensured, since the antenna and/or the connections thereof will break, some remaining attached to bottom tile 8 and others to preformed base 7.

Figure 9:
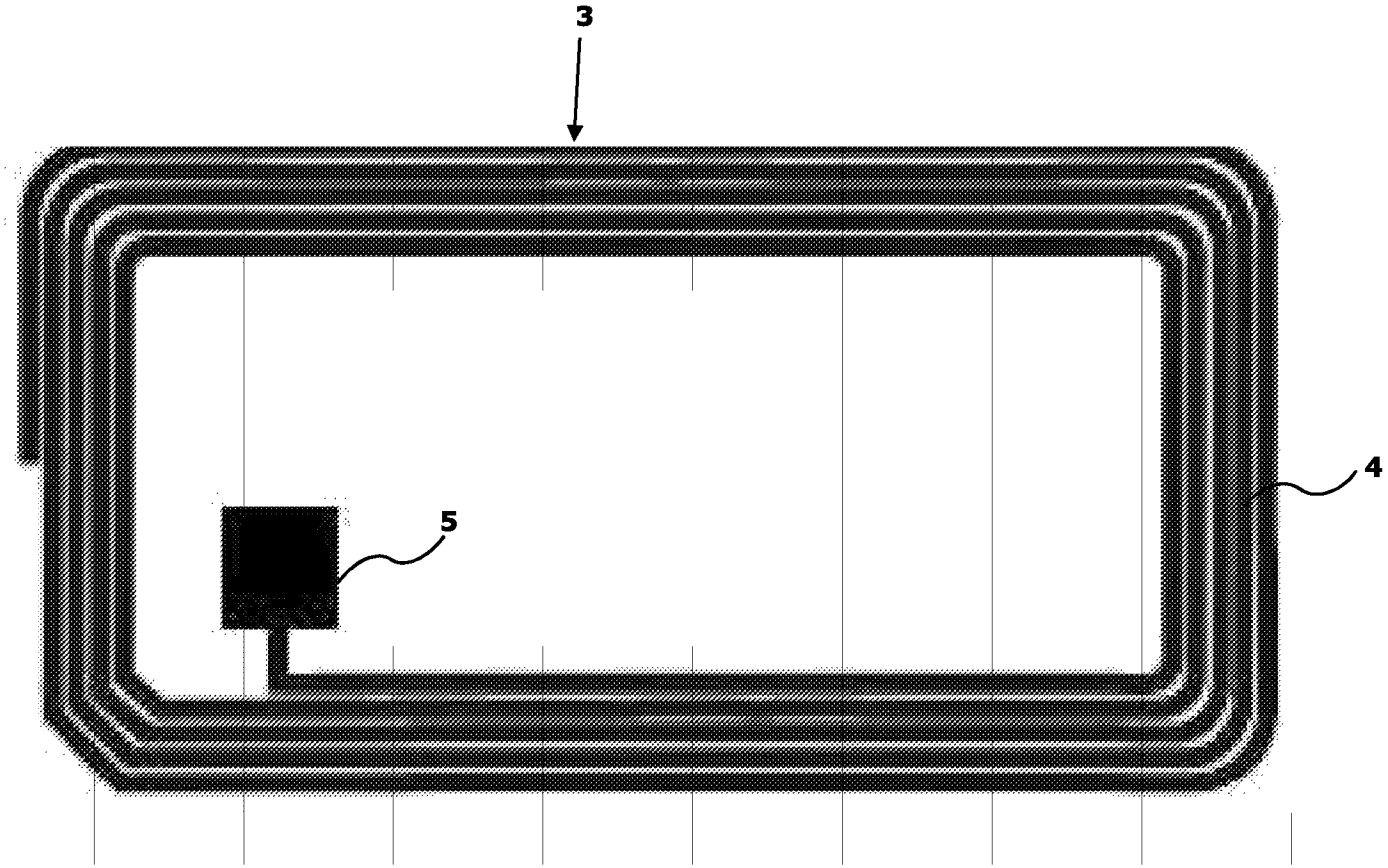
FIG. 9 shows an alternative embodiment of the disposable container according to the present invention with the transponder inserted on the preformed base.

An alternative embodiment is presented in FIG. 9. In this case, the transponder is applied to preformed base 7. The antenna 4 of transponder 3 is applied to preformed base 7, so as to surround the deep-drawn area 6 of the same preformed base 7. Alternatively the antenna may cover said area deep-drawn 6. As in the first embodiment (FIG. 8), the application of transponder 3 and the sealing occur in the same conditions of the previous embodiment.

A further embodiment of the present invention is represented in FIG. 11. It is particularly suited to the case in which the container is used for housing metal objects, such as watches, bullions, coins and others. In this case, in addition to bottom tile 8, to transponder 3 and to preformed base 7, a metal object 15 and a dielectric 16 are represented. Dielectric 16 may have any shape. Preferably, it is a cover, a wrapping, a case or a plug. Dielectric 16 may cover the recess produced by deep-draw 6 or be inserted therein (even by pressure).

The operation of the container according to the present invention is the same for all embodiments and will be hence described once only.

The sealing, as seen above, will occur by joining bottom tile 8, transponder 3 and preformed base 7, with the object to be enclosed, contained in the deep-drawn part 6 of preformed base 7.

When one wants to verify any occurred opening of the container, it is moved closer to the reader and is invested with the signal coming from the same reader of the RFID system. The antenna 4 of transponder 3 thus receives the signal and transmits it to microchip 5, activating it. Said chip, in reply to the signal, radiates it back, modulating it, to the same reader, sending the information it contains. Thus, for example, it will give the univocal and unchangeable code. Of course, microchip 5 can contain other information (for example, the name of the manufacturer or of the subject who has sealed the container and possibly the references to a website owned by them) and, upon receiving the signal from the reader, it will send through antenna 4 all the information it contains to the reader of the RFID system.

The RFID system, in turn, sends the information to the information system, which processes them. For example, the code can be compared against a suitable table or database contained in the information system or in a website accessible thereto and can be used to find information about the stone. An advantageous example is that the univocal unchangeable chip code, the certifier's website and product code are provided. Automatically, the information system, after having verified that the univocal chip code matches in the control database, accesses the certifier's website and enters the product code into a suitable field. Based on this entry, the website issues an electronic copy of the certificate of the precious stone, so that said certificate may be easily downloaded and printed by the purchaser, also on paper.

In case an opening of the container has occurred, since preformed base 7 and bottom tile 8 are mutually joined and each one with different parts of the antenna 4 of transponder 3, it is inevitable that said opening implies the break in one or more points of the same antenna 4. That causes that, even if the sealing is recomposed, antenna 4 is no longer able to operate. Thus, when the signal is transmitted by the RFID reader to antenna 4, antenna 4 is unable to transfer it to microchip 5, nor is it able to transmit to the RFID reader the information contained in microchip 5. Said break might occur also on microchip 5, with a resulting missed sending of data. Thus the deactivation of transponder 3 is obtained. Such breaks are facilitated by an arrangement of glue 14 as in FIG. 10, or the like.

Thereby, after some failed attempts, it can be reasonably presumed that the container has been opened. At this point, it is suitable to analyse in depth the contents or even to renounce to the purchase as a precautionary measure, since the chances that the product has been counterfeited or has deteriorated are evidently very high. An error signal, or of missed answer, can be had also in case whoever opens the package is aware of the presence of transponder 3 and provides to replace transponder 3 or the container with another container containing an own transponder. If the univocal code of said transponder does not appear in the location where it must be recognised, an error signal or a missed answer is generated.

The operation in the case of the embodiment shown in FIG. 11 is similar to the one already illustrated for the first two embodiments. Dielectric 16 has the function of removing, or at least of reducing, the noise which metal object 15 could give to the magnetic field of transponder 3.

The container according to the present invention has been described for the case of precious stones. In the field of precious objects it can be used also for small bullions, coins, stamps, watches and the like.

The present invention will never allow to obtain an endless series of counterfeited products anymore simply having available the information of the good to be counterfeited.

With the present invention an increase of system reliability is obtained, since it moves to a much more advanced level the know-how which a possible counterfeiter must have who in the past had to worry about facing only colours and plastic parts, while today they must be IT experts to be able to decrypt the information contained in the microchip.

It can be used in the field of very high level watches, applied to the case or to the entire product, so as to give the certainty of buying only authentic goods and, in the same field, having the certainty that upon any repair only the manufacturer has handled the watch and not a third, possibly unauthorised party.

A preferred embodiment provides that in order to glue preformed base 7 with bottom tile 8 a glue 14 with a high melting point is used. Since microchip 5 is damaged above a certain temperature, typical of the microchip, it is necessary that the melting point of the glue lies above the deactivation temperature due to thermal damage of the microchip employed. Preferably, the melting point of said glue 14 should lie above 100° C. Even more preferably, it lies between 110° C. and 260° C. Thereby, the possibly attempt to open the container melting glue 14 (so as not to destroy antenna 4 or microchip 5) would nevertheless lead to the deactivation (due to thermal damage) of microchip 5, which takes place—today—at a temperature around 100-110° C. At 260° C. container melting takes place. Thereby, a higher degree of security is reached.

A further increase of the security degree can be reached if, upon a theft, with a theft report, the codes of the stolen products are removed from the check database, so as to obtain, upon authenticity check, the result of a counterfeited product (not allowing connection to the database). Alternatively, upon checking the integrity of the package, one can signal that said product has been stolen; it will hence be an original, but stolen, product.

The present invention allows to accomplish a disposable anti-counterfeiting container with a relevant electronic identification system for high-range and very-high-range products such as: precious goods, watches, diamonds, precious metal bullions, coins, stamps and the like, where a certain electronic identification of the unicity of the purchased product is essential, for the final user. In particular, said product has previously been controlled, possibly certified or in any case univocally detected through a code. Said identification code can thus be identified automatically and certainly, while so far precious stones could be verified, manually entering in the website of the certifying laboratory the identification code of their gemmological certificate. This implied the entry of possible cloned and serially duplicated codes when they were entered in counter-felted containers (blisters). The verification that the final user performed, and which he/she did on a cloned code, caused a product to seem original which in actual fact was counterfeited (since the system of the certifying body recognised that code as original).

However, it is understood that the invention must not be considered limited to the particular arrangement illustrated above, which represents only an exemplifying embodiment thereof, but that different variants are possible, all within the reach of a person skilled in the field, without departing from the scope of protection of the invention, as defined by the following claims.

LIST OF THE REFERENCE CHARACTERS

1 Bottom tile (prior art)
2 Preformed base (prior art)
3 Generic transponder
4 Antenna (of 3)
5 Microchip (of 3)
6 Physical deep-drawing (of 7)
6A Deep-drawing area (critical area)
7 Preformed base
8 Bottom tile
9 —
10 —
11 —
12 Tearing tag
13 Substrate
14 Glue
15 Metal object
16 Dielectric

The invention claimed is:

1. Disposable container for precious goods, manufactured for a single and univocal object, accomplished by mutually joining a base (7) with a preformed recess (6) containing the good to be protected and a closing body (8), wherein a transponder device (3) comprising opposing faces is arranged with each of its faces glued to one of the base (7) and the closing body (8) of the disposable container;

wherein the parts of the transponder (3) attached on the side of the bottom tile (8) are not attached on the side of the preformed base (7) and vice versa;

wherein the transponder is attached to the bottom tile (8) and to the preformed base (7) through a glue (14);

wherein said glue (14) has a high melting point; and wherein the melting point of said glue lies above the deactivation temperature due to thermal damage of the microchip employed within the transponder.

2. Container as in claim 1, wherein said transponder (3) a tearing tag (12) is associated.

3. Container as in claim 2, wherein said tearing tag (12) perforations of a substrate (13) supporting the transponder device (3) extend to at least an antenna (4) of said transponder (3).

4. Container as in claim 1, wherein an antenna (4) of the transponder (3) can be arranged so that it surrounds or covers an area (6A) occupied by a deep-drawing (6) of a preformed base (7).

5. Container as in claim 1, wherein said transponder (3) is a passive-type RFID transponder.

6. Container as in claim 5, wherein said passive RFID transponder (3) is a passive RFID transponder according to the NFC (Near Field Communication) standard.

7. Container as in claim 6, wherein said RFID transponder (3) operates in the frequency band of 13.56 MHz.

8. Container as in claim 1, wherein the melting point of said glue (14) lies above 100° C.

9. Container as in claim 1, wherein said transponder comprises a microchip and an antenna, and wherein said glue (14) is applied on the microchip (5) and/or on the antenna (4), or on parts thereof, and/or on connections of the antenna (4).

10. Container as in claim 1, further comprising a dielectric (16), arranged between the object (15) and the transponder (3) and apt to cover the recess formed by the deep-drawing (6) or to enter the same.

11. Container as in claim 10, wherein the dielectric (16) is a cover, a tile, a wrapping, a case or a plug.

12. Process for checking the integrity and authenticity of a container, comprising the steps of:

a) transmitting a signal from an RFID reader to a transponder device disposed on the container b) verifying the existence of a reply to said signal;

c) transmitting said reply to an information system;

d) comparing, within the information system, the reply with possible acceptable answers; and e) issuing an acceptance or rejection signal, based on the result of step b) and/or of the comparison occurred in step d), wherein said container comprises a disposable container for precious goods manufactured for a single and univocal object accomplished by mutually joining a base (7) with a preformed recess (6) containing the good to be protected and a closing body (8), wherein the transponder device (3) is arranged in a joint between said base and said body; and wherein in light of a theft, with a theft report, a univocal unchangeable code of the transponder device that is associated with the stolen products is removed from the database or a signal of the occurred theft is entered in said database.

* * * * *